US007494203B2

(12) United States Patent
Ito

(10) Patent No.: US 7,494,203 B2
(45) Date of Patent: Feb. 24, 2009

(54) METHOD OF DETERMINING OPERATING DRIVE VOLTAGE OF AN IN-JET HEAD, INK-JET RECORDING APPARATUS AND SUPERPOSED-PATTERN-RECORDED ARTICLE

(75) Inventor: Masaharu Ito, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 429 days.

(21) Appl. No.: 11/359,472

(22) Filed: Feb. 23, 2006

(65) Prior Publication Data

US 2006/0187256 A1 Aug. 24, 2006

(30) Foreign Application Priority Data

Feb. 23, 2005 (JP) ..... 2005-047089

(51) Int. Cl.
*B41J 2/205* (2006.01)

(52) U.S. Cl. ..... 347/15; 347/14; 347/19

(58) Field of Classification Search ..... 347/14, 347/15, 19, 41, 43
See application file for complete search history.

(56) References Cited

U.S. PATENT DOCUMENTS 5,212,497 A 5/1993 Stanley et al.
5,402,159 A 3/1995 Takahashi et al.
6,629,747 B1 * 10/2003 King et al. ..... 347/19
7,367,646 B2 * 5/2008 Cordery et al. ..... 347/19

FOREIGN PATENT DOCUMENTS

JP 5185589 7/1993
JP 3128857 11/2000
JP 2002225287 8/2002

* cited by examiner

*Primary Examiner*—Thinh H Nguyen
(74) *Attorney, Agent, or Firm*—Baker Botts L.L.P.

(57) ABSTRACT

A method of determining an operating drive voltage of an ink-jet head which has an actuator and which ejects, as a result of driving of the actuator, ink droplets toward a recording medium during a relative movement of the ink-jet head and the recording medium for performing recording, the ink-jet head being configured such that an ejection speed of the ink droplets varies depending upon a drive voltage to be applied to the actuator, the method including: recording a first record pattern as a result of driving of the actuator by application of a tentatively determined first test voltage and a second record pattern as a result of driving of the actuator by application of a second test voltage different from the first test voltage, so that the first record pattern and the second record pattern are superposed on each other; and judging whether or not the first test voltage is proper as the operating driving voltage, based on an appearance of a superposed pattern formed by superposition of the first pattern and the second pattern on each other.

20 Claims, 10 Drawing Sheets

FIG.6

RELATIONSHIP BETWEEN DRIVE VOLTAGE AND EJECTION SPEED IN EACH VOLTAGE RANK

| DRIVE VOLTAGE (V) | VOLTAGE RANK | | | | | | |
|---|---|---|---|---|---|---|---|
| | a | 9 | 8 | 7 | 6 | 5 | 4 |
| 25.2 | 11.7 | 11.3 | 10.8 | 10.4 | 10.0 | 9.5 | 9.0 |
| 24.8 | 11.4 | 11.0 | 10.5 | 10.1 | 9.7 | 9.2 | 8.7 |
| 24.4 | 11.2 | 10.8 | 10.3 | 9.9 | 9.5 | 9.0 | 8.5 |
| 24.1 | 11.0 | 10.6 | 10.1 | 9.7 | 9.3 | 8.8 | 8.3 |
| 23.7 | 10.7 | 10.3 | 9.8 | 9.4 | 9.0 | 8.5 | 8.0 |
| 23.4 | 10.5 | 10.1 | 9.6 | 9.2 | 8.8 | 8.3 | 7.8 |
| 23.0 | 10.3 | 9.9 | 9.4 | 9.0 | 8.6 | 8.1 | 7.6 |
| 22.7 | 10.1 | 9.7 | 9.2 | 8.8 | 8.4 | 7.9 | 7.4 |
| 22.3 | 9.9 | 9.5 | 9.0 | 8.6 | 8.2 | 7.7 | 7.2 |
| 22.0 | 9.7 | 9.3 | 8.8 | 8.4 | 8.0 | 7.5 | 7.0 |
| 21.7 | 9.4 | 9.0 | 8.5 | 8.1 | 7.7 | 7.2 | 6.7 |
| 21.3 | 9.2 | 8.8 | 8.3 | 7.9 | 7.5 | 7.0 | 6.5 |
| 21.0 | 9.0 | 8.6 | 8.1 | 7.7 | 7.3 | 6.8 | 6.3 |
| 20.7 | 8.8 | 8.4 | 7.9 | 7.5 | 7.1 | 6.6 | 6.1 |

(unit: m/s)

FIG.7

RELATIONSHIP BETWEEN DRIVE VOLTAGE AND DEVIATION AMOUNT OF DOTS IN EACH VOLTAGE RANK

| DRIVE VOLTAGE (V) | VOLTAGE RANK | | | | | | |
|---|---|---|---|---|---|---|---|
| | a | 9 | 8 | 7 | 6 | 5 | 4 |
| 23.0 | 0.0 | 0.0 | 0.0 | 0.0 | 0.0 | 0.0 | 0.0 |
| 22.7 | -3.1 | -3.4 | -3.8 | -4.1 | -4.5 | -5.1 | -5.8 |
| 22.3 | -6.4 | -6.9 | -7.7 | -8.4 | -9.2 | -10.4 | -11.9 |
| 22.0 | -9.7 | -10.5 | -11.7 | -12.8 | -14.1 | -16.0 | -18.3 |
| 21.7 | -13.1 | -14.3 | -15.9 | -17.4 | -19.2 | -21.8 | -24.9 |
| 21.3 | -16.6 | -18.1 | -20.2 | -22.2 | -24.4 | -27.8 | -31.9 |
| 21.0 | -20.3 | -22.1 | -24.7 | -27.1 | -29.9 | -34.1 | -39.2 |
| 20.7 | -24.0 | -26.1 | -29.3 | -32.2 | -35.6 | -40.6 | -46.8 |
| 20.4 | -27.8 | -30.4 | -34.0 | -37.5 | -41.5 | -47.5 | -54.9 |
| 20.1 | -31.8 | -34.7 | -39.0 | -43.0 | -47.7 | -54.7 | -63.3 |
| 19.8 | -35.9 | -39.2 | -44.1 | -48.7 | -54.1 | -62.2 | -72.2 |
| 19.5 | -40.1 | -43.9 | -49.4 | -54.7 | -60.8 | -70.0 | -81.6 |
| 19.2 | -44.4 | -48.7 | -54.9 | -60.8 | -67.8 | -78.3 | -91.5 |

(unit: μm)

METHOD OF DETERMINING OPERATING DRIVE VOLTAGE OF AN IN-JET HEAD, INK-JET RECORDING APPARATUS AND SUPERPOSED-PATTERN-RECORDED ARTICLE

The present application is based on Japanese Patent Application No. 2005-047089 filed on Feb. 23, 2005, the contents of which are incorporated herein by reference.

BACKGROUND OF THE INVENTION

1. Field of the Invention

The present invention relates in general to a method of determining an operating drive voltage of an ink-jet head which ejects ink droplets to a recording medium upon driving of an actuator for thereby performing printing, an ink-jet recording apparatus and a superposed-pattern-recorded article.

2. Discussion of Related Art

As an ink-jet recording apparatus equipped with this type of ink-jet head, there has been known one which ejects ink in pressure chambers to a recording medium through nozzles by driving an actuator such as a component constituted by piezoelectric elements for thereby changing the pressure in the pressure chambers communicating with the nozzles, so as to perform recording. In this respect, even where the ink-jet head is driven by a specified drive voltage, an ejection speed of the ink droplets may deviate from an intended value due to a variation in the resistance to an ink flow from ink chambers to the nozzles, a variation in the electric characteristic of the actuator and so on. The deviation in the ejection speed may cause deviation in attaching positions of the ink droplets from intended positions, thereby causing a risk of deteriorating the recording quality of the ink-jet recording apparatus. To deal with this, U.S. Pat. No. 5,212,497 corresponding to JP-A-5-185589 discloses a method of adjusting the ejection speed of the ink droplets comprising optically measuring the speed of ejection of the ink droplets from the ink-jet head and adjusting a resistance value of a drive circuit of the actuator by laser trimming, for the purpose of determining the drive voltage of the ink-jet head such that the ejection speed of the ink droplets is equal to an intended prescribed value.

SUMMARY OF THE INVENTION

In the disclosed method, however, the adjustment needs to be performed for each of the ink-jet heads before each ink-jet head is mounted on each printer. Further, the process of adjusting the resistance value of the drive circuit of the actuator is time-consuming. Therefore, the disclosed method requires a relatively long time to determine the drive voltage of the ink-jet head and is disadvantageous in terms of cost.

It is therefore an object of the invention to provide a method of determining an operating drive voltage of an ink-jet head, an ink-jet recording apparatus and a superposed-pattern-recorded article which assure easy evaluation of a speed of ejection of ink droplets from the ink-jet head and which enables judgment as to whether a tentatively determined drive voltage is proper or not as the operating drive voltage of the ink-jet head.

To achieve the above-indicated object, the present invention provides a method of determining an operating drive voltage of an ink-jet head which has an actuator and which ejects, as a result of driving of the actuator, ink droplets toward a recording medium during a relative movement of the ink-jet head and the recording medium for performing recording, the ink-jet head being configured such that an ejection speed of the ink droplets varies depending upon a drive voltage to be applied to the actuator. The method comprises: recording a first record pattern as a result of driving of the actuator by application of a tentatively determined first test voltage and a second record pattern as a result of driving of the actuator by application of a second test voltage different from the first test voltage, so that the first record pattern and the second record pattern are superposed on each other; and judging whether or not the first test voltage is proper as the operating driving voltage, based on an appearance of a superposed pattern formed by superposition of the first pattern and the second pattern on each other.

To achieve the above-indicated object, the present invention provides an ink-jet recording apparatus comprising: an ink-jet head which has an actuator and which ejects, as a result of driving of the actuator, ink droplets toward a recording medium during a relative movement of the ink-jet head and the recording medium for performing recording, the ink-jet head being configured such that an ejection speed of the ink droplets varies depending upon a drive voltage to be applied to the actuator; and a control system which controls the ink-jet recording apparatus and which has a function of executing an operation of recording a first record pattern as a result of driving of the actuator by application of a tentatively determined first test voltage and a second record pattern as a result of driving of the actuator by application of a second test voltage different from the first test voltage, so that the first record pattern and the second record pattern are superposed on each other.

To achieve the above-indicated object, the present invention provides a superposed-pattern-recorded article that is a recording medium on which a superposed pattern is recorded. The superposed pattern is recorded by an ink-jet head which has an actuator and which ejects, as a result of driving of the actuator, ink droplets toward the recording medium during a relative movement of the ink-jet head and the recording medium for performing recording, the ink-jet head being configured such that an ejection speed of the ink droplets varies depending upon a drive voltage to be applied to the actuator. The superposed pattern is recorded by recording a first record pattern as a result of driving of the actuator by application of a tentatively determined first test voltage and a second record pattern as a result of driving of the actuator by application of a second test voltage different from the first test voltage, such that the first record pattern and the second record pattern are superposed on each other. The superposed pattern is arranged such that it is possible to judge, on the basis of an appearance thereof, whether or not the first test voltage is proper as an operating voltage of the actuator.

In the method of determining an operating drive voltage of an ink-jet head, the ink-jet recording apparatus and the superposed-pattern-recorded article according to the present invention, on the basis of the superposed pattern formed by superposition of the first record pattern and the second record pattern, it is possible to visually judge in a short time with ease whether the tentatively determined first test voltage is proper as the operating drive voltage of the ink-jet head by which the ink-jet head is actually operated. Accordingly, it is possible to realize the method of determining the operating drive voltage of the ink-jet head which assures easy evaluation of the speed of ejection of the ink droplets from the ink-jet head and which enables judgment as to whether the tentatively determined first test voltage is proper or not as the operating drive voltage of the ink-jet head.

BRIEF DESCRIPTION OF THE DRAWINGS

The above and other objects, features, advantages and technical and industrial significance of the present invention will be better understood by reading a following detailed description of preferred embodiments of the invention, when considered in connection with the accompanying drawings, in which:

FIG. 6 is a table indicating a relationship between drive voltage and ejection speed in each voltage rank;

FIG. 7 is a table showing a relationship between drive voltage and deviation amount of dots recorded at drive voltage, from dots recorded at basic drive voltage;

DETAILED DESCRIPTION OF THE INVENTION

<Main Structure of Ink-Jet Recording Apparatus>

Figure 1:
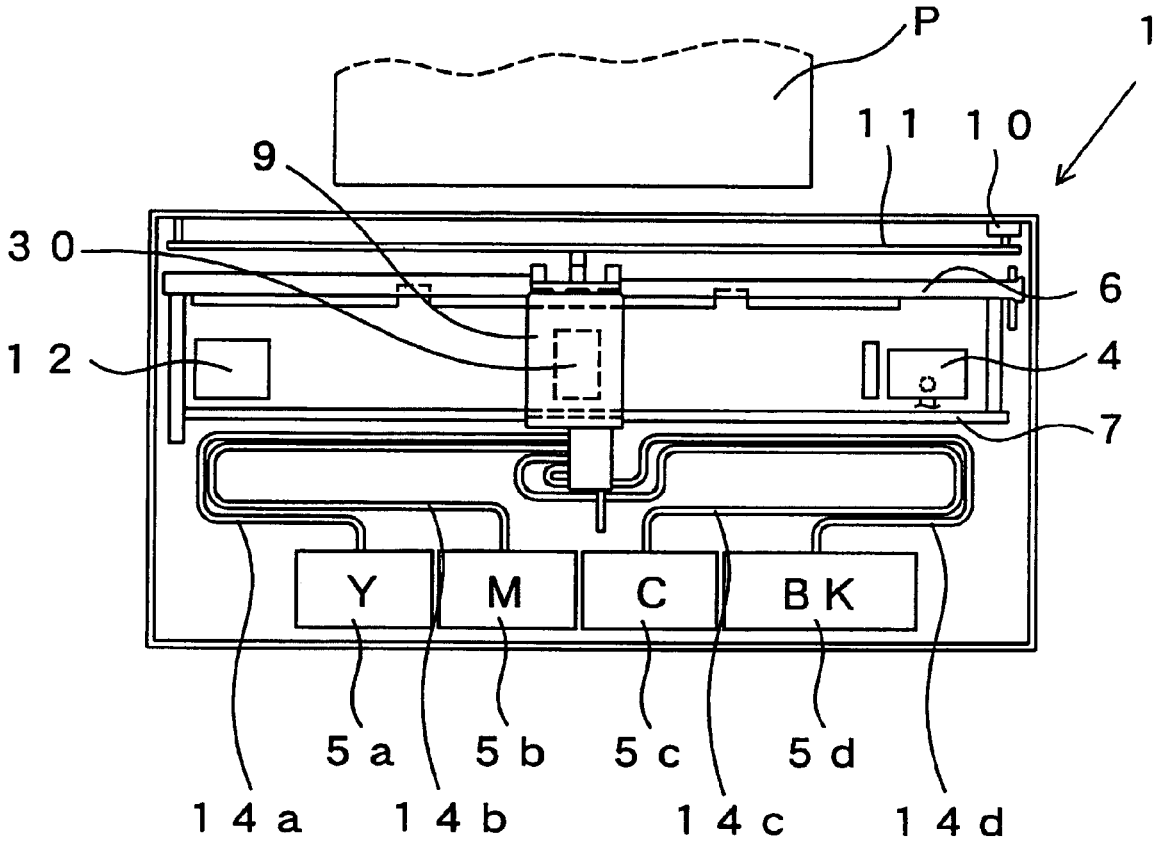
FIG. 1 is a plan view showing a main structure of an ink-jet recording apparatus.

Referring first to the plan view of FIG. 1, there will be explained a main structure of an ink-jet recording apparatus used in practicing a method of determining an operating drive voltage of an ink-jet head according to the present invention. In an inside of the ink-jet recording apparatus indicated by 1 in FIG. 1, there are disposed two guide shafts 6, 7 to which is fixed a head holder 9 functioning also as a carriage. The head holder 9 holds an ink-jet head 30 which ejects ink to a recording medium in the form of a recording sheet P. The head holder 9 is connected to an endless belt 11 rotated by a carriage motor 10 and is moved along the guide shafts 6, 7 upon driving of the carriage motor 10. A known strip-like timing index member (not shown) is provided so as to extend along the guide shaft 7. There is provided, on the timing index member, a mark for detecting a position of the head holder 9.

In a main body of the ink-jet recording apparatus 1, there are disposed ink tanks 5*a*-5*d* which respectively store a yellow ink, a magenta ink, a cyan ink and a black ink. The ink tanks 5*a*-5*d* are connected to a tube joint 20 (FIG. 2) via respective flexible tubes 14*a*-14*d*. A flushing portion 12 is disposed at one end of the ink-jet recording apparatus 1 as viewed in a direction in which the head holder 9 moves (i.e., a main scanning direction) while a maintenance portion 4 is disposed at the other end. The ink-jet head 30 ejects poor-quality ink containing air bubbles to the flushing portion 12 and thereby maintains ink ejection performance in good condition. At the maintenance portion 4, there are conducted suction of the ink containing the air bubbles, wiping of a nozzle surface of the ink-jet head 30 and so on, for maintaining the ink ejection performance in good condition.

<Main Structure of Ink-Jet Head>

Figure 2:
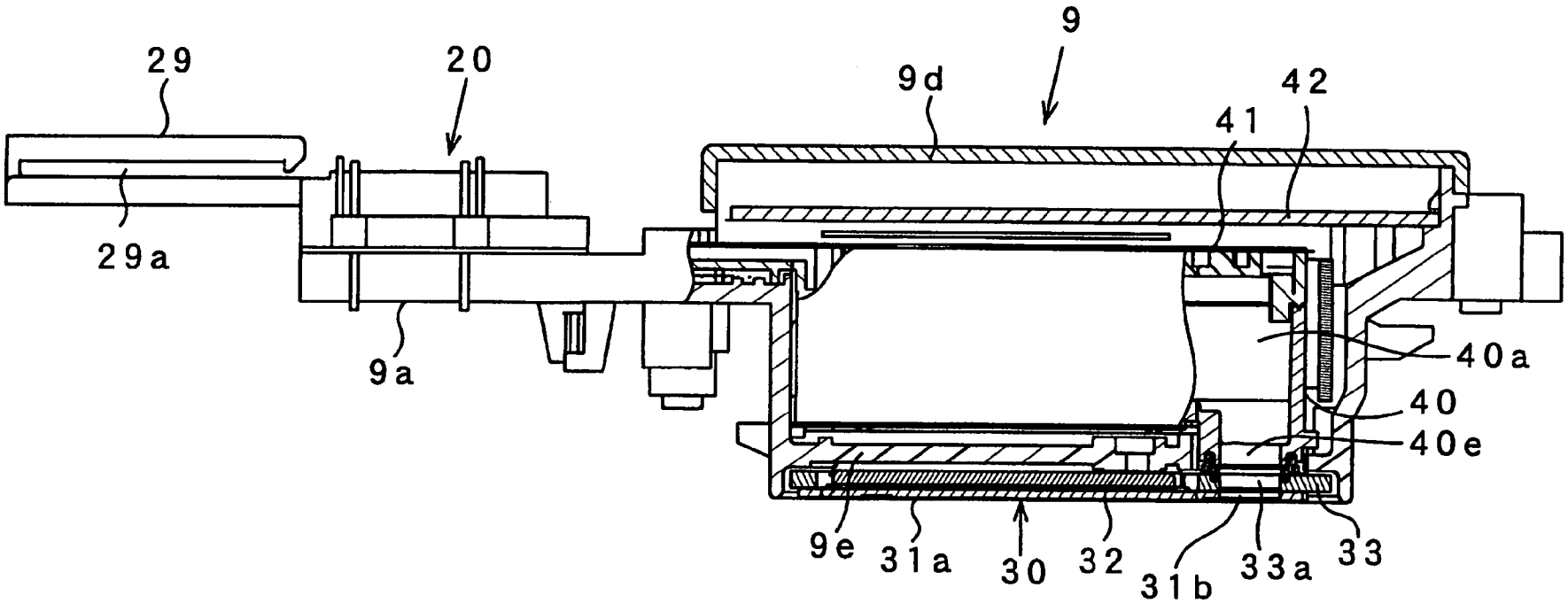
FIG. 2 is a vertical cross sectional view showing an ink-jet head and a head holder.
Figure 3:
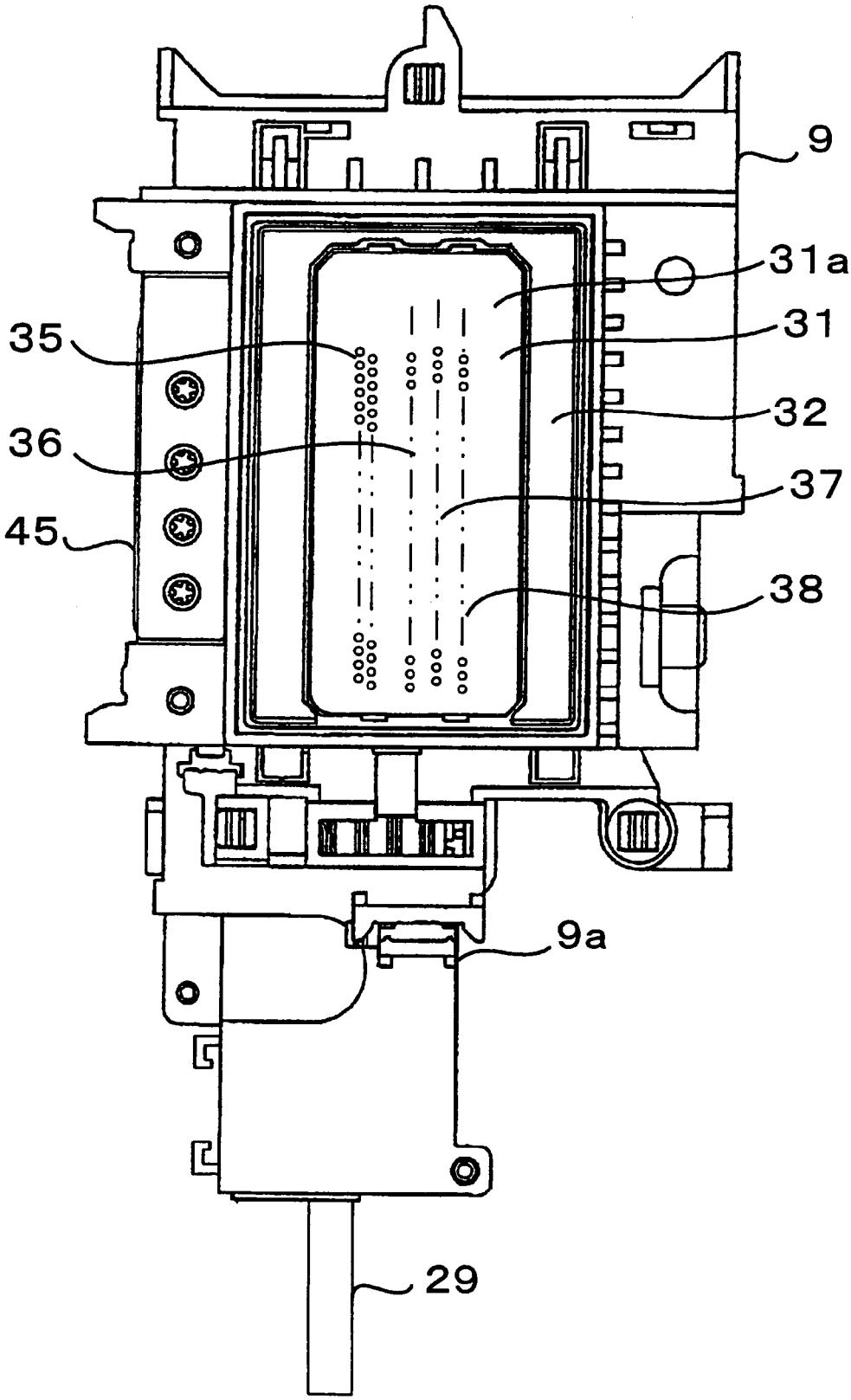
FIG. 3 is a view as seen from a nozzle-surface side in FIG. 2.

Referring next to FIGS. 2 and 3, there will be explained a main structure of the ink-jet head 30. In the following explanation, one surface of the ink-jet recording apparatus 1 from which the ink is ejected is referred to as a lower surface and a direction in which the ink is ejected is referred to as a downward direction while another surface thereof opposite to the above-indicated one surface (lower surface) is referred to as an upper surface and a direction opposite to the direction of ink ejection is referred to as an upward direction. Further, a direction toward the lower side as seen in FIG. 1 (i.e., the front of the ink-jet recording apparatus 1) is referred to as a frontward direction and a direction toward the upper side as seen in FIG. 1 is referred to as a rearward direction.

As shown in FIG. 2, the head holder 9 has a box-like configuration and a bottom wall 9*e*. The ink-jet head 30 is held by the head holder 9 at a lower surface of the bottom wall 9*e*. The ink-jet head 30 has a laminar structure in which are laminated a cavity portion 31 (FIG. 3) having a multiplicity of ink flow passages and an actuator 32 formed by piezoelectric elements which selectively give a pressure for ink ejection to the ink in the ink flow passages. The ink-jet head 30 includes, on a lower surface of the cavity portion 31 functioning as a nozzle surface 31*a*, nozzles 35-38 which are arranged in a plurality of rows respectively corresponding to the inks of the four different colors. The ink-jet head 30 further includes, on an upper surface of the cavity portion 31, ink inlets 31*b* provided independently for the respective inks. The actuator 32 of the ink-jet head 30 has a structure disclosed in U.S. Pat. No. 5,402,159 corresponding to Japanese Patent No. 3128857, for instance, in which a plurality of piezoelectric sheets having a size that covers the multiplicity of the ink flow passages are stacked on one another with individual electrodes corresponding to the respective ink flow passages and a common electrode having a size that covers the multiplicity of the ink flow passages being alternately interposed between adjacent two of the plurality of the piezoelectric sheets. By selectively applying a drive voltage between the individual electrodes and the common electrodes, the actuator deforms in a direction of stacking of the piezoelectric sheets, thereby giving the ink in the ink flow passages the pressure for ejection. To an upper surface of the ink-jet head 30, there is fixed by bonding a reinforcing frame 33 in which are formed ink path holes 33*a* so as to correspond to the respective ink inlets 31*b*. An integral unit of the ink-jet head 30 and the reinforcing frame 33 is disposed along the lower surface of the bottom wall 9*e* of the head holder 9 and fixed to the bottom wall 9*e* using an adhesive.

In a space above the bottom wall 9*e* of the head holder 9, a buffer tank 40 is accommodated over the ink-jet head 30 on one side of the ink-jet head 30 remote from the recording sheet P. Within the buffer tank 40, there are formed ink storage portions 40*a* which are provided independently for the respective inks of different colors and which are defined by partition walls. Each ink storage portion 40*a* communicates with the corresponding ink inlet 31*b* through a corresponding one of ink supply holes 40*e* which are formed for the respective ink storage portions 40*a*, and the corresponding ink path hole 33*a* of the reinforcing frame 33. The ink storage portions 40*a* are covered at upper openings thereof with a flexible film-like member 41. In detail, the film-like member 41 is formed of a resin film and is fixed by ultrasonic welding, for instance, to upper ends of the partition walls defining the ink storage portions 40*a* and an upper end of an outer wall of the buffer tank 40. At an upper portion of each ink storage portion 40*a*, a predetermined amount of the air is stored as known in the art. Owing to the air stored at the upper portion of each ink storage portion 40*a* and the film-like member 41, a variation in the pressure of the ink caused by the movement of the ink-jet head 30 is absorbed. The air exceeding the predetermined amount is discharged to an exterior by an air-discharge device 45 (FIG. 3) provided on a side surface of the buffer tank 40.

An arm portion 9*a* is formed integrally with the head holder 9 so as to extend from a front end of the same 9 horizontally in the forward direction. The buffer tank 40 has an extended portion formed at its front end so as to extend in parallel with the arm portion 9*a* of the head holder 9 such that the extended portion is superposed on the arm portion 9*a*. To the extended portion of the buffer tank 40, the tube joint 20 is connected. The flexible tubes 14*a*-14*d* (FIG. 1) extending from the corresponding ink tanks 5*a*-5*d* are connected to the tube joint 20. The tube joint 20 is removably mounted on the extended portion of the buffer tank 40 and has communication passages (not shown) respectively communicating with the corresponding tubes 14*a*-14*d*. The buffer tank 40 has communication openings (not shown) which communicate with the respective ink storage portions 40*a* and which are formed in the extended portion so as to be open to its upper surface. The communication passages of the tube joint 20 communicate with the respective communication openings of the buffer tank 40, whereby the inks in the respective ink tanks 5*a*-5*d* can be supplied to the corresponding ink storage portions 40*a*. At the front end of the tube joint 20, a support member 29 is formed so as to extend therefrom. In a slit 29*a* of the support member 29, there is inserted a flexible flat cable not shown for electrically connecting an electric circuit board 42 described below to a controller not shown disposed in the main body.

At an upper opening of the head holder 9 (i.e., on one side of the buffer tank 40 remote from the ink-jet head 30), the rigid electric circuit board 42 is disposed. In detail, the electric circuit board 42 is supported by an upper end of the wall constituting the head holder 9, such that the electric circuit board 42 is removably fixed to the upper end of the wall. Further, a covering member 9*d* is provided above the electric circuit board 42 so as to cover the same 42. The covering member 9*d* has a box-like shape which is open downwards for covering the upper opening of the head holder 9.

<Main Structure of Control System>

Figure 4:
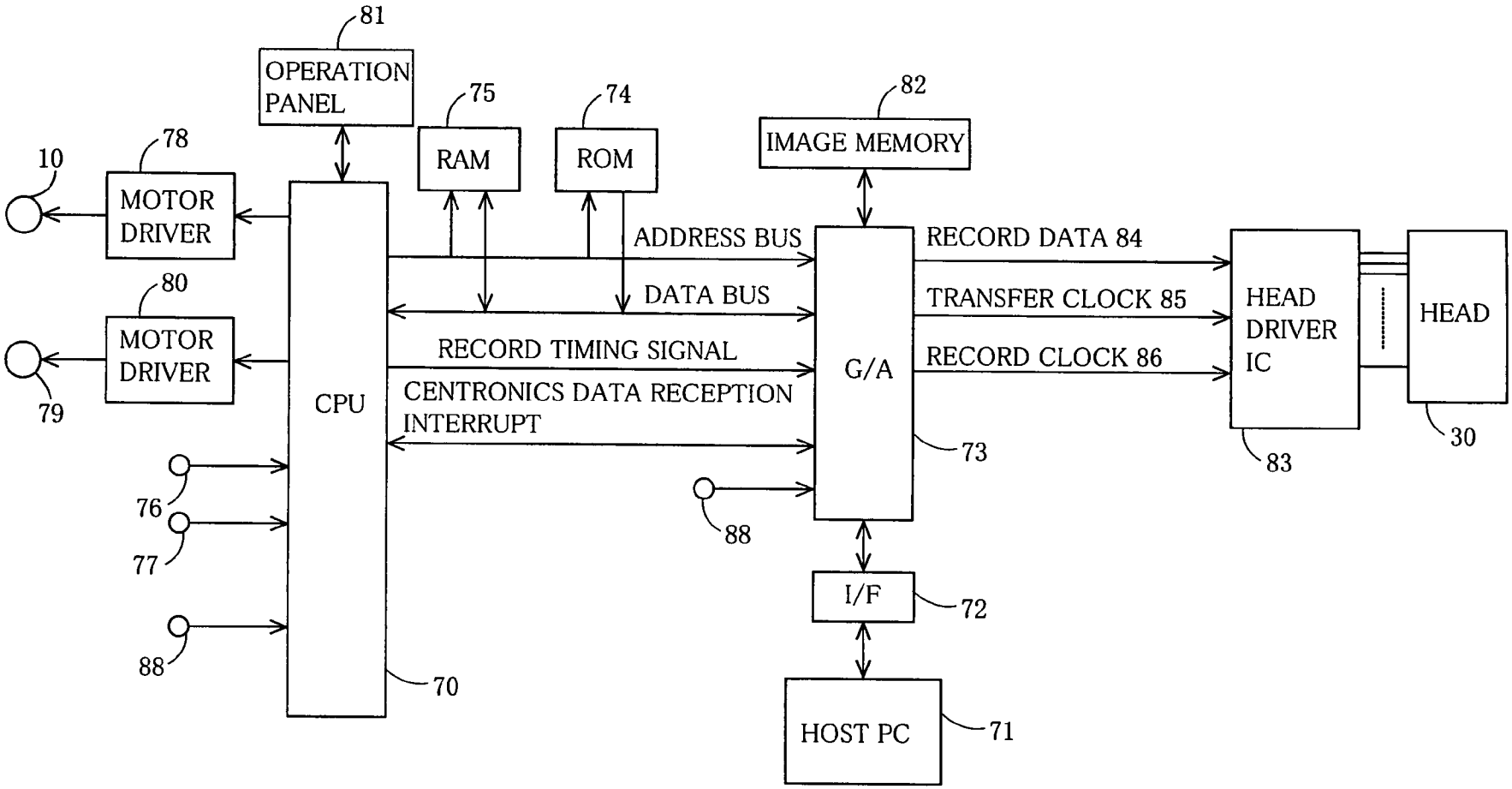
FIG. 4 is a block diagram showing a main structure of a control system of the ink-jet recording apparatus of FIG. 1.

Referring next to the block diagram of FIG. 4, there will be explained a main structure of a control system of the ink-jet recording apparatus 1. As shown in FIG. 4, the ink-jet recording apparatus 1 includes a CPU 70 which controls record commands to the ink-jet head 30 and a gate array (G/A) 73 which receives, via an interface (I/F) 72, record data transmitted from a host computer (host PC) 71 and controls development of the data. To an address bus and a data bus which connect the CPU70 and the gate array 73 to each other, there are connected: a ROM 74 in which are stored operation programs executed by the CPU 70, etc.; and a RAM 75 for temporarily storing the data received by the gate array 73. The CPU 70 handles communication of necessary data with the ROM 74 and the RAM 75. Data of a basic pattern 51 and a varying pattern 52 which will be explained are stored in the ROM 74. The controller indicated above is constituted by including the CPU 70, the ROM 74, the gate array 73 and so on.

To the CPU 70, there are connected: a paper sensor 76 for detecting presence and absence of the recording sheet P; a carriage home position sensor 77 for detecting that the head holder 9 is at a home position; a temperature sensor 88 for detecting an environmental temperature; a motor driver 78 for driving the carriage motor 10; a motor driver 80 for driving a line-feed (LF) motor 79 which is for feeding the recording sheet P in a direction perpendicular to the main scanning direction; and an operation panel 81 which is for giving various signals to the CPU 70. A head driver IC 83 operates based on record data 84, transfer clock 85 and record clock 86 outputted from the gate array 73, and drives the ink-jet head 30. To the gate array 73, there is also connected an encoder sensor 87 for detecting the mark of the timing index member in accordance with the movement of the head holder 9 and determining record timing.

<Method of Determining Operating Drive Voltage of Ink-Jet Head>

Figure 5:
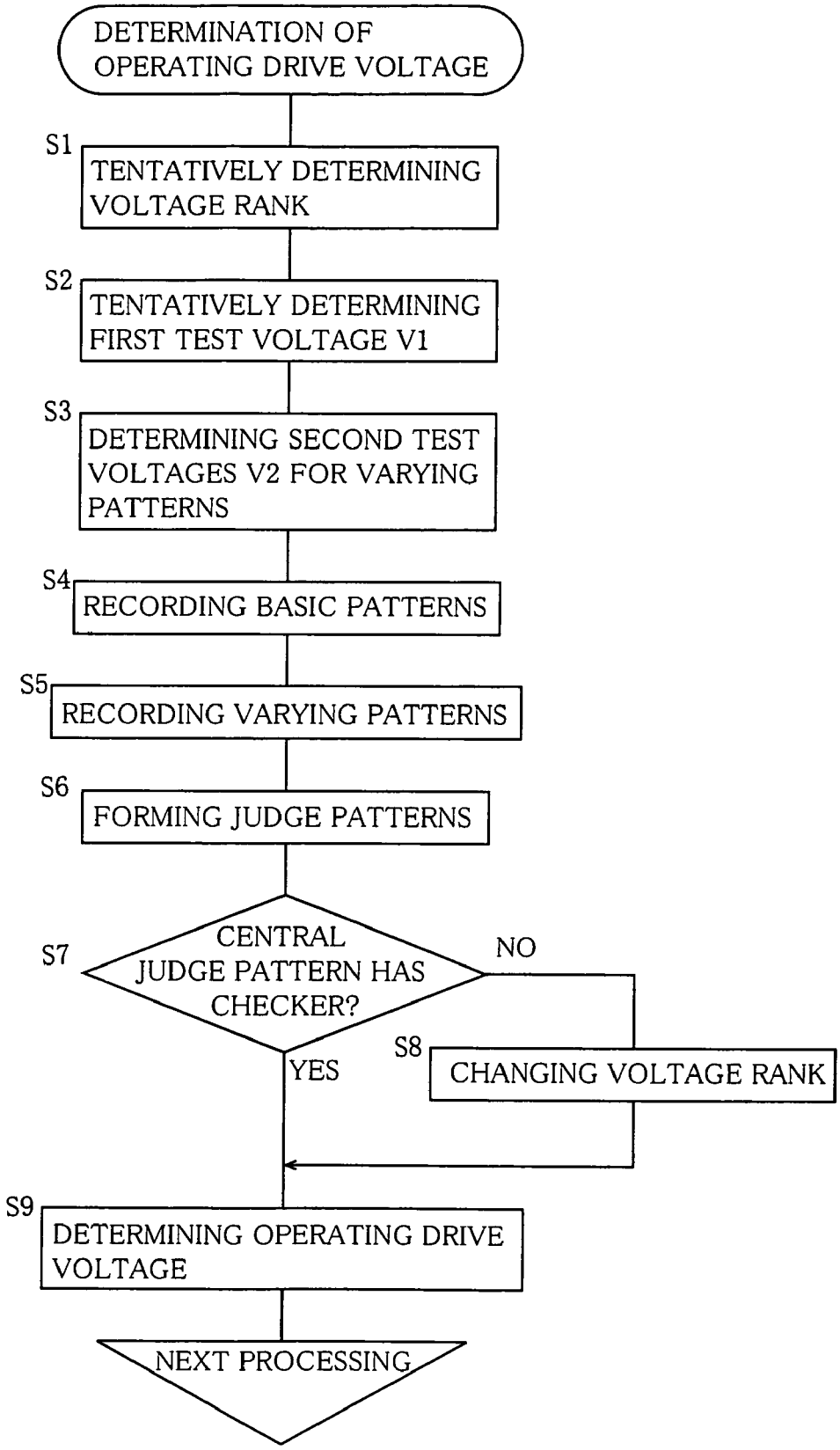
FIG. 5 is a flow chart for determining an operating drive voltage of the ink-jet head.
Figure 8:
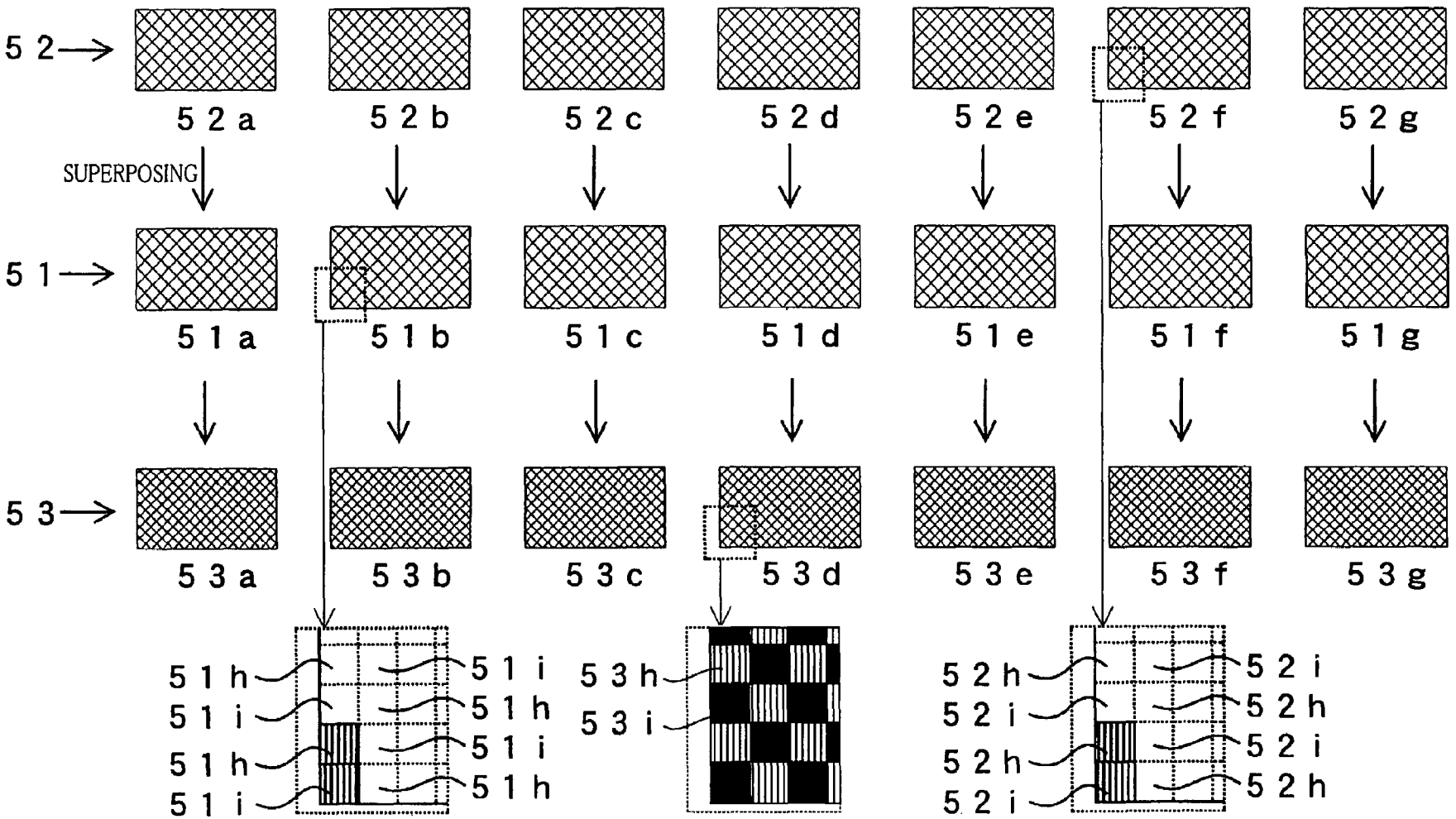
FIG. 8 is a schematic view for explaining how a judge pattern is formed.

Referring to FIG. 5 through FIG. 10, there will be explained a method of determining an operating drive voltage of the ink-jet head 30 by which the ink-jet head 30 is operated in an actual recording operation. FIG. 5 is a flow chart for determining the operating drive voltage. FIG. 6 is a table showing a relationship between drive voltage and median value of ejection speed in each voltage rank of the ink-jet head 30. FIG. 7 is a table showing a relationship between drive voltage and deviation amount of dots recorded at drive voltage in each voltage rank, from dots recorded at basic drive voltage. FIG. 8 is a schematic view for explaining how a judge pattern 53 is formed. FIGS. 9A and 9B are enlarged schematic views respectively showing a basic pattern 51 and a varying pattern 52 for forming the judge pattern 53. FIGS. 10A-10G are partially enlarged view of FIG. 8 for showing a change in the appearance of the judge pattern 53. The basic pattern 51, the varying pattern 52 and the judge pattern 53 will be explained in greater detail.

"Voltage rank" indicated in the table of FIG. 6 is a rank relating to a magnitude of a drive voltage to be applied to the actuator for obtaining a design value of the ejection speed of the ink droplets in the ink-jet head 30. To attain the ejection speed of the ink droplets of 9 m/s in the present embodiment, for instance, the drive voltage of 23 V is to be applied for the ink-jet head 30 belonging to the voltage rank "7" and the drive voltage of 21 V is to be applied for the ink-jet head 30 belonging to the voltage rank "a". The drive voltage to be applied differs depending upon the voltage rank because of differences in the resistance to the ink flow in the cavity portion 31 and the electric characteristic of the actuator 32 due to variations in manufacture of the ink-jet head 30. Accordingly, the determination of the voltage rank is made by measuring, in advance, the resistance to the ink flow, the electric characteristic and so on. The inventors of the present invention measured the ejection speed of the ink droplets by changing the drive voltage for the ink-jet head 30 belonging to each voltage rank indicated in the table of FIG. 6 and found that the ejection speed increases in substantially linear proportion to an increase in the drive voltage.

The table of FIG. 7 shows deviation amounts of recorded dots for each voltage rank when the varying pattern 52 is recorded at respective drive voltages decreasing in steps from 23 V as a basic drive voltage. The deviation of the dots in a direction opposite to the moving direction of the head holder 9 is interpreted as positive. Therefore, where the dots are deviated in the moving direction of the head holder 9, the deviation amount is shown in negative values. It is noted that a distance between an open end of each of the nozzles 35-38 and the recording sheet P is 1.5 mm. Further, the moving speed of the head holder 9 carrying the ink-jet head 30 in the main scanning direction is 40 IPS (inch/second). The position at which each dot is to be recorded is determined by a vector sum of a vector of the ejection speed of the ink droplets and a vector of the moving speed of the head holder 9 in the main scanning direction where the distance between the open end of each nozzle and the recording sheet P is constant. Where the drive voltage decreases down from 23V as the basic drive voltage, the ejection speed of the ink droplets decreases. Accordingly, the vector of the moving speed of the head holder 9 in the main scanning direction contributes much more to the position at which each dot is to be recorded. Therefore, with a decrease in the ejection speed, the amount of deviation of each dot in the moving direction of the head holder 9 increases.

The inventors noticed that there is substantially accurate correlation between the magnitude of the drive voltage and the position of each dot recorded on the recording sheet because the drive voltage is in substantially linear proportion to the ejection speed. Thus, the inventors conceived a determination whether the drive voltage of the ink-jet head 30 is proper or not. Namely, a predetermined record pattern is recorded on the recording sheet while suitably changing the drive voltage for visually indicating the deviation of the record pattern recorded on the recording sheet, thereby judging whether an intended ejection speed is attained by the drive voltage of a tentatively determined voltage rank.

Figure 9A:
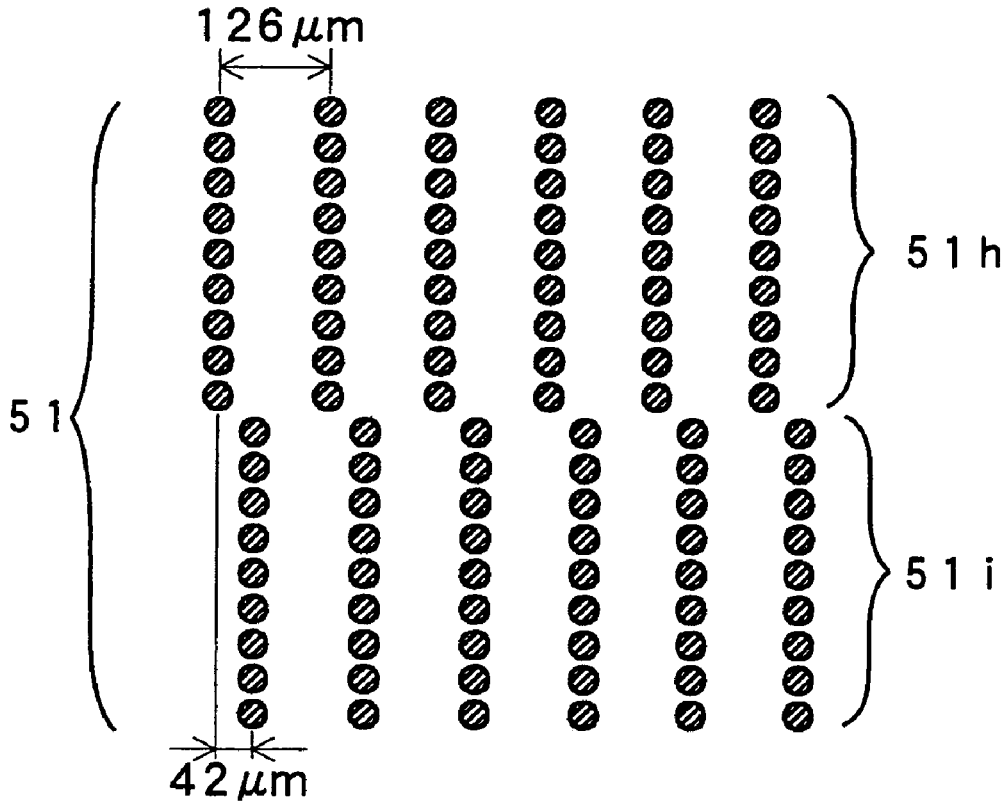
FIGS. 9A and 9B are enlarged views respectively showing a basic pattern and a varying pattern for forming the judge pattern.

FIG. 9A schematically shows, in enlargement, a portion of the basic pattern 51 as a first record pattern where the recording density is 600 dpi. Here, the portion shown in FIG. 9A is a portion recorded by eighteen nozzles arranged on one straight line among the nozzles 35 for ejecting the black ink. Where the recording density in the main scanning direction is 600 dpi, a dot pitch is 42 μm. As shown in FIG. 9A, the dots of the basic pattern 51 are arranged in a lattice form. The basic pattern 51 includes a plural sets of an upper portion 51*h* as a first portion and a lower portion 51*i* as a second portion, the plural sets of the upper and lower portions 51*h*, 51*i* being adjacent to one another in a direction perpendicular to the main scanning direction. In each upper portion 51*h*, a plurality of dot rows each consisting of nine dots are disposed in parallel with each other so as to be spaced apart from each other in the main scanning direction with an interval of 126 μm corresponding to three times the dot pitch. In each lower portion 51*i*, a plurality of dot rows similar to those in the upper portion 51*h* are disposed so as to be shifted from the corresponding rows in the upper portion 51*h* to the right in the main scanning direction by a distance of 42 μm corresponding to the dot pitch. In the present embodiment, the interval with which the dot rows of each of the upper portion 51*h* and the lower portion 51*i* are spaced apart from each other is three times the dot pitch, i.e., 126 μm.

Figure 9B:
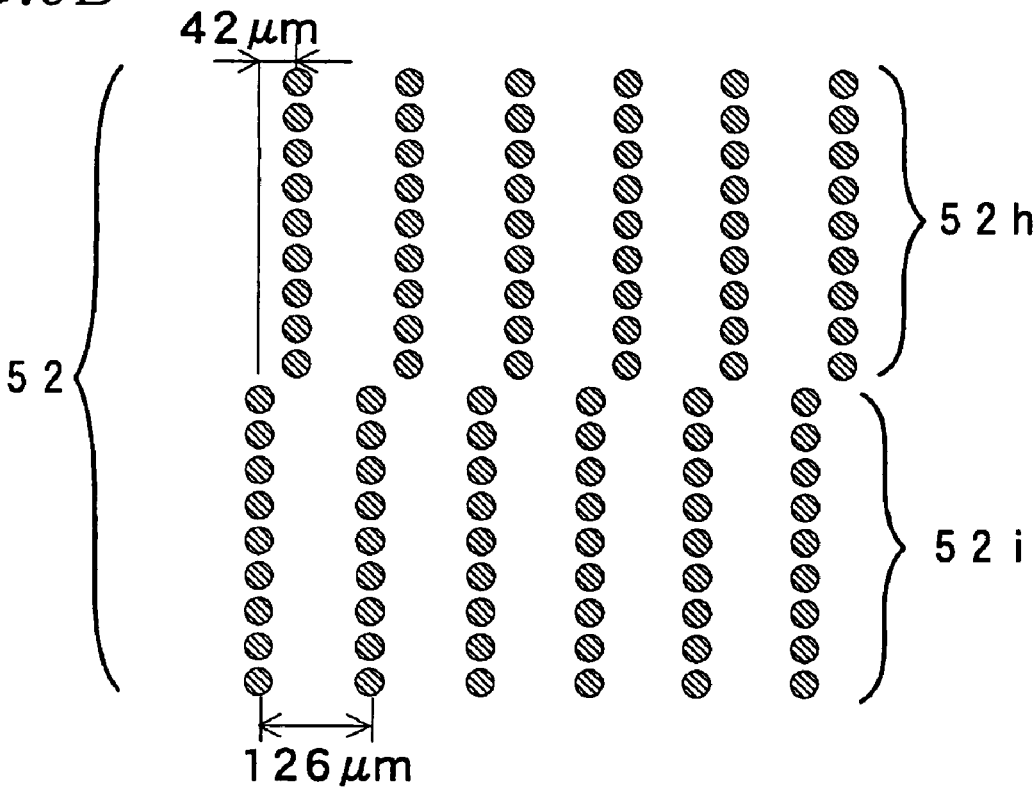

FIG. 9B schematically shows, in enlargement, a portion of the varying pattern 52 as a second record pattern. As in the basic pattern 51 described above, the dots of the varying pattern 52 are arranged in a lattice form. The varying pattern 52 includes a plural sets of an upper portion 52*h* as a first portion and a lower portion 52*i* as a second portion. In each of the upper and lower portions 52*h*, 52*i*, a plurality of dot rows are disposed in parallel with each other in the main scanning direction. The dot rows in each lower portion 52*i* are shifted by a distance of 42 μm corresponding to the dot pitch from the corresponding dot rows in the upper portion $\mathbf{52}_i$ to the left in the main scanning direction, contrary to the above-mentioned basic pattern 51. Each lower portion 51*i* of the basic pattern 51 and each lower portion 52*i* of the varying pattern 52 have a positional relationship wherein the dots of the lower portion 51*i* of the basic pattern 51 and the dots of the lower portion 52*i* of the varying pattern 52 are respectively located at the same positions _in the main scanning direction when being recorded at the same drive voltage.

As shown in a partially enlarged view of FIG. 8, in the basic pattern 51, the plural sets of the upper portion 51*h* and the lower portion 51*a* are disposed such that each lower portion 51*a* is adjacent to each upper portion 51*h* in the main scanning direction and in the direction perpendicular to the main scanning direction. In the varying pattern 52, a plural sets of the upper portion 52*h* and the lower portion 52*i* are disposed in a manner similar to that in the basic pattern 51. The basic pattern 51 and the varying pattern 52 are recorded on the recording sheet P so as to be superposed on each other in a manner explained below.

Next, there will be described a method of determining the operating drive voltage of the ink-jet head 30 by referring to the flow chart of FIG. 5. Initially, a voltage rank of the ink-jet head 30 is tentatively determined in Step S1 (hereinafter "Step" is omitted) based on the resistance to the ink flow in the ink-jet head 30 and the electric characteristic of the actuator 32. The resistance to the ink flow can be estimated according to a method disclosed in JP-A-2002-225287, for instance. Namely, a fluid is supplied to the ink flow passages of the cavity portion 31 for a predetermined time by a pump not shown, and a flow amount by which the fluid flows in the predetermined time is measured. For estimation of the resistance to the ink flow, the diameter of the nozzles 35-38 is taken into account. In this respect, the diameter of the nozzles may be separately measured and converted into a resistance value. The converted resistance value may be added to the entire resistance to the ink flow. The electric characteristic of the actuator 32 may include the electrostatic capacity and the electric resistance value of the piezoelectric material and can be measured according to a known method. Hereinafter, an explanation is made with respect to the ink-jet head 30 whose voltage rank is tentatively determined as "7".

As shown in FIG. 8, in the present embodiment, seven basic patterns 51*a*-51*g* are formed in the main scanning direction and seven varying patterns 52*a*-52*g* are formed so as to be superposed on the corresponding basic patterns 51*a*-51*g*. The seven basic patterns 51*a*-51*g* are recorded at a constant drive voltage V1 while the seven varying patterns 52*a*-52*g* are recorded at mutually different drive voltages V2. The drive voltage V1 (as a first test voltage or a basic voltage) is determined in S2 and the drive voltages V2 (each as a second test voltage) are determined in S3. In S2, on the basis of the tentatively determined voltage rank, a voltage by which an intended ejection speed is attained is set as the basic voltage V1 according to the relationship shown in the table of FIG. 6. In the ink-jet head 30 belonging to the voltage rank "7", a drive voltage corresponding to the intended ejection speed of 9 m/s is 23 V, so that the basic voltage V1 is set to be 23 V.

Subsequently, a voltage at which a central varying pattern 52*d* among the seven varying patterns 52*a*-52*d* is recorded at a position deviating, by 42 μm, from a position where the varying pattern 52 is recorded at the basic drive voltage V1 and which is lower than the basic voltage V1 (the first test voltage) is determined as the drive voltage (the second test voltage) V2 for the central varying pattern 52*d* (S3). Here, the voltage value of 20.1 (V) is the closest in the voltage rank "7" as shown in the table of FIG. 7, so that the drive voltage V2 for the central varying pattern 52*d* is set to be 20.1 V. The drive voltages V2 for the varying patterns 52*a*, 52*b*, 52*c*, 52*e*, 52*f* and 52*g* other than the central varying pattern 52*d* are determined so as to be shifted from each other by a predetermined voltage difference, i.e., 0.3 V, with the drive voltage of the central varying pattern 52*d* set at 20.1 V. Namely, the drive voltages V2 for the varying patterns 52*a*, 52*b*, 52*c*, 52*e*, 52*f* and 52*g* are set at 21.0 V, 20.7 V, 20.4 V, 19.8 V, 19.5 V and 19.2 V, respectively.

The ink-jet head 30 is driven at the basic voltage of 23 V, thereby recording a plurality of basic patterns 51 (S4). Here, the head holder 9 is moved in a rightward direction as seen in FIG. 8, whereby seven basic patterns 51*a*-51*g* are recorded side by side as shown in FIG. 8 as a result of one scanning movement of the head holder 9.

Subsequently, the seven varying patterns 52*a*-52*g* are recorded at the respective drive voltages V2 determined as described above as a result of seven scanning movements of the head holder 9, such that the varying patterns 52*a*-52*g* are superposed on the corresponding basic patterns 51*a*-51*g*, respectively (S5). Described more specifically, in the first scanning movement of the head holder 9, the varying pattern 52*a* is recorded at the drive voltage of 21.0 V so as to be superposed on the leftmost basic pattern 51*a*. Next, in the second scanning movement, the varying pattern 52*b* is recorded at the drive voltage of 20.7 V which is lower than 21.0 V by 0.3 V, so as to be superposed on the second basic pattern 51*b* from the left. With the drive voltage decreased in steps by 0.3 V, one varying pattern 52 is recorded for one scanning movement of the head holder 9, so as to be superposed on one basic pattern 51. As a result of the seventh scanning movement of the head holder 9, the varying pattern 52*g* is recorded at the drive voltage of 19.2 V so as to be superposed on the rightmost basic pattern 51*g*. Thus, the recording of the varying pattern 52 is completed. As described above, the varying patterns 52*a*-52*g* are recorded in order at the respective drive voltages decreasing in steps down from 21.0 V to 19.2 V as described above, such that the varying patterns 52*a*-52*g* are superposed on the respective basic patterns 51*a*-51*g*, whereby seven judge patterns 53*a*-53*g* each as a superposed pattern are formed (S6). The recording sheet P on which the judge patterns 53*a*-53*g* are recorded as described above is a superposed-pattern-recorded article.

The basic pattern 51 and the varying pattern 52 may be recorded on the recording sheet a plural times so as to be displaced by a prescribed amount in the sub scanning direction perpendicular to the main scanning direction. In this case, dot spaces in the basic pattern 51 as seen in the sub scanning direction are filled with the dots of other basic pattern 51 while dot spaces in the varying pattern 52 as seen in the sub scanning direction are filled with the dots of other varying pattern 52. Accordingly, the basic pattern 51 (51*a*-51*g*) and the varying pattern 52 (52*a*-52*g*) are recorded at resolution higher than that of the ink-jet head 30, whereby the concentration of the judge pattern 53 (53*a*-53*g*) is increased, simplifying recognition of the judge pattern 53 (53*a*-53*g*).

Subsequently, the tentatively determined basic voltage V1 (the first test voltage) is judged to be proper or not as the operating drive voltage for the ink-jet head 30. If the tentatively determined voltage rank is proper, in the central judge pattern 53*d* shown in FIG. 10D, the dot rows in the lower portion 52*i* of the varying pattern 52 are shifted by 43 μm from the dot rows in the lower portion 51*a* of the basic pattern 51 while the dot rows in the upper portion 51*h* of the basic pattern 51 and the dot rows in the upper portion 52*h* of the varying pattern 52 are substantially completely superposed on one another. Strictly, the dot rows in the upper portion 51*h* of the basic pattern 51 and the dot rows in the upper portion 52*h* of the varying pattern 52 are shifted from each other by a distance of 1 μm. However, such a small distance is negligible. Thus, in the judge pattern 53*d*, each upper portion 53*h* thereof formed by the upper portions 51*h*, 52*h* of the superposed basic and varying patterns 51, 52 seems to have low concentration, that is, the area occupied by the dots with respect to the entire area of the upper portion 53*h* of the judge pattern 53 is small whereas each lower portion 53*i* formed by the lower portions 51*i*, 52*i* of the superposed basic and varying patterns 51, 52 seems to have high concentration, that is, the area occupied by the dots with respect to the entire area of the upper portion 53*i* of the judge pattern 53 is large. Accordingly, the judge pattern 53*d* having a plural sets of the upper and lower portions 53*h*, 53*i* appears to be a checker having high contrast as indicated in FIG. 8 wherein a part of the judge pattern 53*d* is enlarged. Namely, an affirmative answer "YES" is obtained in S7.

Figure 10A:
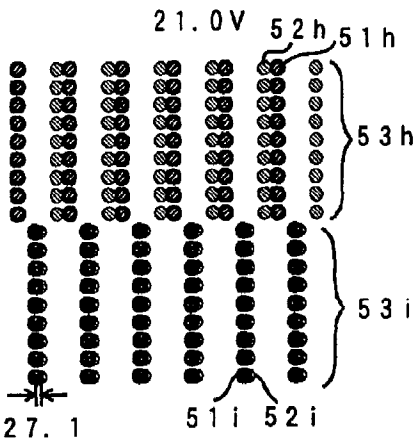
FIGS. 10A-10G are partially enlarged views of FIG. 8 for showing a change in the appearance of the judge pattern.
Figure 10B:
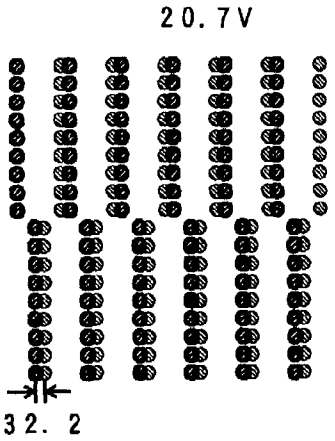
Figure 10C:
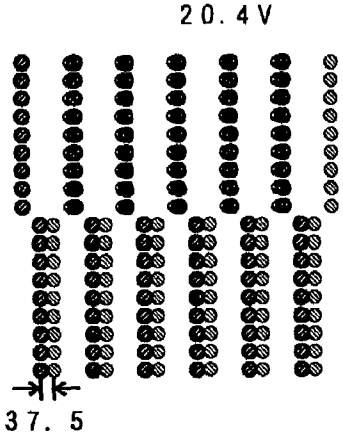
Figure 10D:
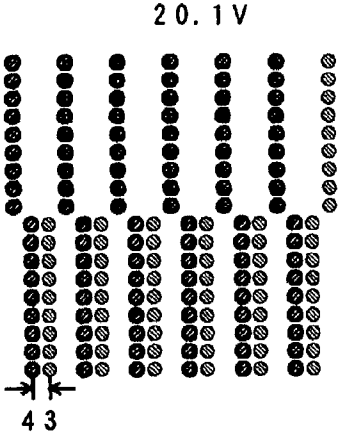
Figure 10E:
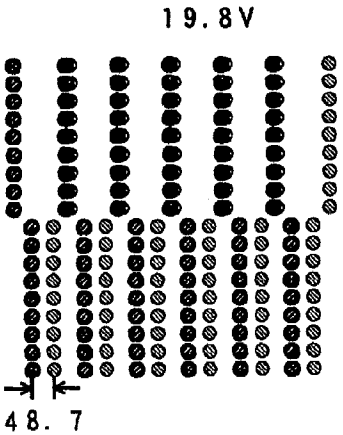
Figure 10F:
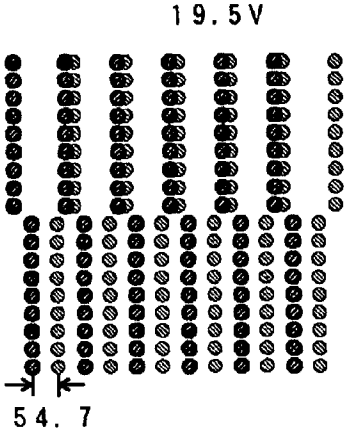
Figure 10G:
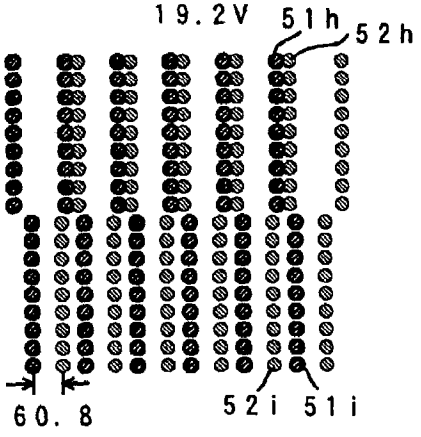

In the judge patterns 53*c*, 53*b*, and 53*a* located in order on the left side of the central judge pattern 53*d*, the second test voltages V2 respectively determined for recording the varying patterns 52*c*, 52*b* and 52*a* become higher toward the left side. Therefore, the dot rows of each lower portion 51*a* of the basic pattern 51 and the dot rows of each lower portion 52*i* of the varying pattern 52 gradually approach toward each other toward the left side as shown in FIGS. 10C-10A, so that each lower portion 53*i* of the judge pattern 53 has concentration that becomes lower toward the left side. On the contrary, the dot rows of each upper portion 51*h* of the basic pattern 51 and the dot rows of each upper portion 52*h* of the varying pattern 52 are gradually separated away from each other toward the left side as shown in FIGS. 10C-10A, so that the concentration of each upper portion 53*h* of the judge pattern 53 becomes higher toward the left side. Accordingly, the contrast of the checker of the judge pattern 53 varies toward the left side. In the judge patterns 53*e*, 53*f* and 53*g* located in order on the right side of the central judge pattern 53*d*, the second test voltages V2 respectively determined for recording the varying patterns 52*e*, 52*f* and 52*g* become lower toward the right side. Therefore, the dot rows of each lower portion 51*a* of the basic pattern 51 and the dot rows of each lower portion 52*i* of the varying pattern 52 are gradually separated away from each other toward the right side as shown in FIGS. 10E-10G. Similarly, the dot rows of each upper portion 51*h* of the basic pattern 51 and the dot rows of each upper portion 52*h* of the varying pattern 52 are gradually separated away from each other toward the right side as shown in FIGS. 10E-10G, so that the concentration of each upper portion 53*h* of the judge pattern 53 becomes higher toward the right side. Therefore, the contrast of the checker of the judge pattern 53 gradually decreases toward the right side in the order of 53*e*, 53*f*, 53*g*. If the tentatively determined voltage rank is proper, the checker has the highest contrast in the central judge pattern 53*d* because each upper portion 53*h* of the central judge pattern 53*d* has the lowest concentration among the upper portions 53*h* of the seven judge patterns 53*a*-53*g*. As a result, the tentatively determined first test voltage (basic voltage) of 23 V is determined as the operating drive voltage for the ink-jet head 30 (S9).

If the checker of the central judge pattern 53*d* does not have the highest contrast (S7: NO), the tentatively determined voltage rank is not proper. In this instance, it is possible to estimate a proper voltage rank on the basis of the location of one of the other six judge patterns 53*a*, 53*b*, 53*c*, 53*e*, 53*f* and 53*g* whose checker has the highest contrast; and the second test voltage V2 determined for recording the varying pattern 52 in the above-indicated one of the judge patterns 53*a*, 53*b*, 53*c*, 53*e*, 53*f* and 53*g* whose checker has the highest contrast. Where the checker has the highest contrast in the leftmost judge pattern 53*a*, for instance, the second test voltage V2 determined for recording the varying pattern 52*a* in the judge pattern 53*a* is 21.0 V. Accordingly, it can be concluded that the ink-jet head 30 belongs to the voltage rank "4" in which the deviation amount at 21.0 V is the closest to 42 μm among the seven ranks, as indicated in the table of FIG. 7. In this case, the voltage rank of the ink-jet head 30 is changed from "7" to "4" (S8) and the first test voltage (the basic voltage) V1 is changed (S9), namely, increased to from 23 V to 25.2 V because the drive voltage for attaining the intended ejection speed of 9 mi/s in the ink-jet head belonging to the voltage rank "4" is equal to 25.2 V as shown in the table of FIG. 6. Preferably, the voltage value of 25.2 (V) is tentatively determined as the first test voltage V1, and the processing in S2 (i.e., the determination of the second test voltages V2 for recording the varying patterns 52*a*-52*g*) and the processing in the subsequent steps are executed for judging whether the tentatively determined first test voltage V1 is proper or not as the operating drive voltage of the ink-jet head 30 whose voltage rank is labeled as "4", in a manner similar to that described above.

In the illustrated embodiment mentioned above, the seven varying patterns 52*a*-52*g* are recorded at the mutually different second test voltages so as to be superposed on the corresponding seven basic patterns 51*a*-51*g*, respectively, thereby forming the respective judge patterns 53*a*-53*g* which are arranged in a certain direction. It is therefore easy to make a comparison of the appearance of the judge patterns 53*a*-53*g* and grasp the change in the appearance, thereby making it ease to judge whether or not the tentatively determined first test voltage V1 is proper as the operating drive voltage for the ink-jet head 30.

As mentioned above, because the second test voltages V2 for recording the respective varying patterns 52*a*-52*g* are shifted from each other by the predetermined voltage difference, it is easy to grasp a relationship between the change of the second test voltages V2 and the appearance of the judge patterns 53*a*-53*g* which are formed by respectively superposing the basic patterns 51*a*-51*g* and the varying patterns 52*a*-52*g* on one another.

Because the second test voltages V2 determined for recording the respective varying patterns 52*a*-52*g* are lower than the tentatively determined first test voltage (basic voltage) V1, the ejection speeds of the ink by the respective second test voltages V2 do not exceed the ejection speed by the first test voltage V1. Accordingly, the ejection speed does not become too high, so that it is avoidable that meniscus formed at ink-ejection openings of the nozzles by surface tension of the ink is broken. Therefore, there is no fear of ink ejection failure which would be caused by the break of the meniscus.

In the illustrated embodiment, the first test voltage (the basic voltage) V1 for recording the basic pattern 51 is tentatively determined by comprehensively considering various factors that influence the ejection speed of the ink droplets, such as the resistance to the ink flow in the ink-jet head 30 and the electrical characteristic of the actuator 32. Therefore, the first test voltage V1 can be determined without suffering from a relatively large error, thereby reducing a time required for judging whether the first test voltage V1 is proper or not as the operating drive voltage for the ink-jet head 30.

The basic pattern 51 and the varying pattern 52 have the respective upper portions 51*h*, 52*h* and the respective lower portions 51*i*, 52*i* which are arranged such that the deviation amount of the dots of each upper portion 51*h* of the basic pattern 51 from the dots of each upper portion 52*h* of the varying pattern 52 is made different from the deviation amount of the dots of each lower portion 51*a* of the basic pattern 51 from the dots of each lower portion 52*i* of the varying pattern 52 when the varying pattern 52 is recorded by driving the actuator at the second test voltage V2 such that the basic pattern 51 and the varying pattern 52 are superposed on each other. Accordingly, in the judge pattern 53 formed by the superposed basic and varying patterns 51, 52, there is formed a boundary between each upper portion 53*h* of the judge pattern 53 formed by the upper portions 51*h*, 52*h* and each lower portion 53*i* of the judge pattern 53 formed by the lower portions 51*i*, 52*i*. Namely, the appearance of judge pattern 53 is represented as the checker shown in FIG. 10 made by the plural sets of the upper and lower portions 53*h*, 53*i*. As compared with a case where the appearance of the judge pattern 53 is recognized simply based on its concentration or the appearance of the judge pattern 53 is represented as simple lines, the appearance of the judge pattern 53 represented as the checker enables easy recognition.

The appearance of the judge pattern 53 is not limited to the checker described above, but may be suitably changed as long as the appearance is easy to recognize. For instance, the appearance of the judge pattern 53 may have a design having dark portions and light portions or may be represented as circular lines, for instance. Even where the appearance of the judge pattern 53 is changed as described above, the effect mentioned above with respect to the illustrated embodiment can be obtained. Further, only one of the upper portions 51*h*, 52*h* and the lower portions 51*i*, 52*i* may be utilized and only a change in the concentration may be recorded in each judge pattern 53.

The voltage rank of the ink-jet head 30 may be determined as follows: An ink-jet head may be extracted from a certain lot, and a voltage rank determined for that ink-jet head may be tentatively set as a representative value of the voltage rank of all of the ink-jet heads belonging to the lot. In this case, the voltage rank is determined on the basis of the data extracted from the lot in which the characteristics of the ink-jet heads are estimated to be closely related to each other, so that there is little risk of causing large errors. Accordingly, it is possible to save time and labor for tentatively determining the voltage rank of each of the individual ink-jet heads while enjoying the effect explained above with respect to the illustrated embodiment.

The present method may be practiced as follows. Prior to mounting of the head holder 9 holding the ink-jet head 30 on the ink-jet recording apparatus, the head holder 9 holding the ink-jet head 30 is installed in a test device under the same conditions as those in the ink-jet recording apparatus. In this state, the procedure for determining the operating drive voltage of the ink-jet head may be performed.

It is to be understood that the present invention may be embodied with various changes and modifications, which may occur to those skilled in the art, without departing from the spirit and scope of the invention defined in the attached claims.

What is claimed is:

1. A method of determining an operating drive voltage of an ink-jet head which has an actuator and which ejects, as a result of driving of the actuator, ink droplets toward a recording medium during a relative movement of the ink-jet head and the recording medium for performing recording, the ink-jet head being configured such that an ejection speed of the ink droplets varies depending upon a drive voltage to be applied to the actuator, the method comprising:

recording a first record pattern as a result of driving of the actuator by application of a tentatively determined first test voltage and a second record pattern as a result of driving of the actuator by application of a second test voltage different from the first test voltage,so that the first record pattern and the second record pattern are superposed on each other; and judging whether or not the first test voltage is proper as the operating driving voltage, based on an appearance of a superposed pattern formed by superposition of the first pattern and the second pattern on each other, wherein the first record pattern is composed of a plurality of dots which are formed by ejection of the ink droplets, and the second record pattern is composed of a plurality of dots which are formed by ejection of the ink droplets and which respectively correspond to the dots of the first record pattern constituting the first record pattern, wherein the first record pattern and the second record pattern are set such that an appearance of the superposed pattern changes depending upon a change in a positional relationship between each of the dots of the first record pattern and a position of each of the dots of the second record pattern which respectively correspond to the dots of the first record pattern, and a change in the positional relationship depends on a difference between the first test voltage and the second test voltage, and wherein at least one of a degree of superposition and a degree of separation by which the dots of the first record pattern and the corresponding dots of the second record pattern are superposed on each other and separated away from each other, respectively, changes depending upon the difference between the first test voltage and the second test voltage, whereby the first record pattern and the second record pattern are set such that the appearance of the superposed pattern changes depending upon a change in a tone of the superposed pattern.

2. The method according to claim 1, wherein the first record pattern and the second record pattern are set such that the appearance of the superposed pattern varies depending upon the difference between the first test voltage and the second test voltage.

3. The method according to claim 1, wherein the first record pattern and the second record pattern are recorded on the recording medium a plural times so as to be displaced by a prescribed amount in a direction perpendicular to a direction of the relative movement of the ink-jet head and the recording medium.

4. The method according to claim 1, wherein the first record pattern and the second record pattern are set such that the dots of the first record pattern and the dots of the second record pattern are respectively arranged in a plurality of rows which are spaced apart from each other with a prescribed interval in a direction of the relative movement of the ink-jet head and the recording medium.

5. The method according to claim 4, wherein the interval with which the plurality of rows are spaced apart from each other is an integral multiple of a recording pitch at the highest recordable density in the direction of the relative movement of the ink-jet head and the recording medium.

6. The method according to claim 1, wherein each of the first record pattern and the second record pattern includes a first portion and a second portion, and the first record pattern and the second record pattern are set such that the first portion of the first record pattern and the first portion of the second record pattern are superposed on each other while the second portion of the first record pattern and the second portion of the second record pattern are superposed on each other, and such that a deviation amount of the dots of the first portion of the first record pattern from the dots of the first portion of the second record pattern is made different from a deviation amount of the dots of the second portion of the first record pattern from the dots of the second portion of the second record pattern.

7. The method according to claim 6, wherein the first portion and the second portion of each of the first record pattern and the second record pattern are set such that the dots of the first portion and the second portion are arranged in a plurality of rows which are spaced apart from each other with a prescribed interval in a direction of the relative movement of the ink-jet head and the recording medium, and such that the rows of the first portion of the first record pattern are shifted by a prescribed distance from the rows of the second portion of the first record pattern while the rows of the first portion of the second record pattern are shifted by the prescribed distance from the rows of the second portion of the second record pattern in a direction opposite to a direction in which the rows of the first portion of the first record pattern are shifted.

8. The method according to claim 7, wherein the prescribed interval with which the rows of each of the first portion and the second portion of each of the first record pattern and the second record pattern are spaced apart is equal to a multiple of an integer not smaller than two of a recording pitch at the highest recordable density in a direction of the relative movement of the ink-jet head and the recording medium, the prescribed distance by which the rows of the first portion are shifted from the rows of the second portion being set as the recording pitch.

9. The method according to claim 6, wherein each of the first record pattern and the second record pattern includes a plurality of the first portions and a plurality of the second portions, and the first record pattern and the second record pattern are set such that the superposed pattern forms a checker by the plurality of the first portions and the plurality of the second portions.

10. The method according to claim 1, wherein the second test voltage is lower than the first test voltage.

11. The method according to claim 1, further comprising tentatively determining the first test voltage to be a voltage at which the ejection speed of the ink droplets is estimated to be a prescribed speed, on the basis of a resistance to an ink flow in the ink-jet head and an electric characteristic of the actuator.

12. A method of determining an operating drive voltage of an ink-jet head which comprises an actuator and which ejects, as a result of driving of the actuator, ink droplets toward a recording medium during a relative movement of the ink-jet head and the recording medium for performing recording, the ink-jet head being configured such that an ejection speed of the ink droplets varies depending upon a drive voltage to be applied to the actuator, the method comprising:

recording a first record pattern as a result of driving of the actuator by application of a tentatively determined first test voltage and a second record pattern as a result of driving of the actuator by application of a second test voltage different from the first test voltage, such that the first record pattern and the second record pattern are superposed on each other; and judging whether the first test voltage is proper as the operating driving voltage, based on an appearance of a superposed pattern formed by superposition of the first pattern and the second pattern on each other, wherein a plurality of the first record patterns and a plurality of the second record patterns are recorded, wherein the plurality of the second record patterns are recoded by respectively applying, to the actuator, a plurality of the second test voltages which are mutually different, and wherein the judging whether or not the first test voltage is proper as the operating drive voltage is made based on respective appearances of a plurality of superposed patterns formed by superposition of the plurality of the first record patterns and the plurality of the second record patterns, respectively.

13. The method according to claim 12, wherein the plurality of the second record patterns are recorded by respectively applying, to the actuator, the plurality of the second test voltages which are shifted from each other by a predetermined voltage difference.

14. An ink-jet recording apparatus, comprising:

an ink-jet head which has an actuator and which ejects, as a result of driving of the actuator, ink droplets toward a recording medium during a relative movement of the ink-jet head and the recording medium for performing recording, the ink-jet head being configured such that an ejection speed of the ink droplets varies depending upon a drive voltage to be applied to the actuator; and a control system which controls the ink-jet recording apparatus and which has a function of executing an operation of recording a first record pattern as a result of driving of the actuator by application of a tentatively determined first test voltage and a second record pattern as a result of driving of the actuator by application of a second test voltage different from the first test voltage, so that the first record pattern and the second record pattern are superposed on each other, wherein the first record pattern is composed of a plurality of dots which are formed by ejection of the ink droplets, and the second record pattern is composed of a plurality of dots which are formed by ejection of the ink droplets and which respectively correspond to the dots of the first record pattern constituting the first record pattern, and wherein the first record pattern and the second record pattern are set such that an appearance of the superposed pattern changes depending upon a change in a positional relationship between each of the dots of the first record pattern and each of dots of the second record pattern that respectively correspond to the dots of the first record pattern, the change in the positional relationship depending on a difference between the first test voltage and the second test voltage.

15. The ink jet recording apparatus according to claim 14, wherein at least one of a degree of superposition and a degree of separation by which the dots of the first record pattern and the corresponding dots of the second record pattern are superposed on each other and separated away from each other, respectively, changes depending upon the difference between the first test voltage and the second test voltage, whereby the first record pattern and the second record pattern are set such that the appearance of the superposed pattern changes depending upon a change in a tone of the superposed pattern.

16. A superposed-pattern-recorded article that is a recording medium on which a superposed pattern is recorded, wherein the superposed pattern is recorded by an ink-jet head which has an actuator and which ejects, as a result of driving of the actuator, ink droplets toward the recording medium during a relative movement of the ink-jet head and the recording medium for performing recording, the ink-jet head being configured such that an ejection speed of the ink droplets varies depending upon a drive voltage to be applied to the actuator, wherein the superposed pattern is recorded by recording a first record pattern as a result of driving of the actuator by application of a tentatively determined first test voltage and a second record pattern as a result of driving of the actuator by application of a second test voltage different from the first test voltage, such that the first record pattern and the second record pattern are superposed on each other, and wherein the superposed pattern is arranged such that it is possible to judge, on the basis of an appearance thereof, whether or not the first test voltage is proper as an operating voltage of the actuator, wherein the first record pattern is composed of a plurality of dots which are formed by ejection of the ink droplets, and the second record pattern is composed of a plurality of dots which are formed by ejection of the ink droplets and which respectively correspond to the dots of the first record pattern constituting the first record pattern, and wherein the first record pattern and the second record pattern are set such that the appearance of the superposed pattern changes depending upon a change in a positional relationship between each of the dots of the first record pattern and each of dots of the second record pattern that respectively correspond to the dots of the first record pattern, the change in the positional relationship depending on a difference between the first test voltage and the second test voltage.

17. The superposed-pattern-recorded article according to claim 16, wherein each of the first record pattern and the second record pattern includes a first portion and a second portion, and the first record pattern and the second record pattern are set such that the first portion of the first record pattern and the first portion of the second record pattern are superposed on each other while the second portion of the first record pattern and the second portion of the second record pattern are superposed on each other, and such that a deviation amount of the dots of the first portion of the first record pattern from the dots of the first portion of the second record pattern is made different from a deviation amount of the dots of the second portion of the first record pattern from the dots of the second portion of the second record pattern.

18. The superposed-pattern-recorded article according to claim 17, wherein each of the first record pattern and the second record pattern includes a plurality of the first portions and a plurality of the second portions, and the first record pattern and the second record pattern are set such that the superposed pattern forms a checker by the plurality of the first portions and the plurality of the second portions.

19. A superposed-pattern-recorded article that is a recording medium on which a superposed pattern is recorded, wherein the superposed pattern is recorded by an ink-jet head which comprises an actuator and which is configured to eject, as a result of driving of the actuator, ink droplets toward the recording medium during a relative movement of the ink-jet head and the recording medium for performing recording, and the ink-jet head is configured such that an ejection speed of the ink droplets varies depending upon a drive voltage to be applied to the actuator, wherein the superposed pattern is recorded by recording a first record pattern as a result of driving of the actuator by application of a tentatively determined first test voltage and a second record pattern as a result of driving of the actuator by application of a second test voltage different from the first test voltage, such that the first record pattern and the second record pattern are superposed on each other, wherein the superposed pattern is arranged such that it is possible to judge, on the basis of an appearance thereof, whether or not the first test voltage is proper as an operating voltage of the actuator, wherein a plurality of the superposed patterns are recorded on the recording medium, and wherein the plurality of the superposed patterns are recorded by recording a plurality of the first record patterns and a plurality of the second patterns so as to be superposed on one another, the plurality of the second patterns being recorded as a result of driving of the actuator by respectively applying a plurality of the second test voltages which are mutually different.

20. An ink-jet recording apparatus, comprising:

an ink-jet head comprising an actuator and configured to eject, as a result of driving of the actuator, ink droplets toward a recording medium during a relative movement of the ink-jet head and the recording medium for performing recording, wherein the ink-jet head is configured such that an ejection speed of the ink droplets varies depending upon a drive voltage to be applied to the actuator; and a control system which controls the ink-jet recording apparatus and which is configured to execute an operation of recording a first record pattern as a result of driving of the actuator by application of a tentatively determined first test voltage and a second record pattern as a result of driving of the actuator by application of a second test voltage different from the first test voltage, such that the first record pattern and the second record pattern are superposed on each other to form a superposed pattern, wherein a plurality of the superposed patterns are recorded on the recording medium, and wherein the plurality of the superposed patterns are recorded by recording a plurality of the first record patterns and a plurality of the second patterns so as to be superposed on one another, the plurality of the second patterns being recorded as a result of driving of the actuator by respectively applying a plurality of the second test voltages which are mutually different.

* * * * *